US005315907A

United States Patent [19]

Biagiotti

[11] Patent Number: 5,315,907

[45] Date of Patent: May 31, 1994

[54] MACHINE FOR CUTTING LOGS OF WEB MATERIAL

[75] Inventor: Guglielmo Biagiotti, Capannori, Italy

[73] Assignee: Fabio Perini S.p.A., Lucca, Italy

[21] Appl. No.: 856,449

[22] Filed: Mar. 24, 1992

[30] Foreign Application Priority Data

Apr. 3, 1991 [IT] Italy ..... FI/91/A 71

[51] Int. Cl.[5] ..... B26D 1/60

[52] U.S. Cl. ..... 83/38; 83/298; 83/313; 83/318; 83/329; 83/446; 83/734

[58] Field of Search ..... 83/37, 38, 155, 298, 83/313, 318, 325, 326, 329, 330, 446, 490, 734

[56] References Cited

U.S. PATENT DOCUMENTS

| | | | |
|---|---|---|---|
| 572,374 | 12/1896 | Richards | 83/329 X |
| 1,095,599 | 5/1914 | Rosewarne | 83/329 X |
| 1,242,478 | 10/1917 | Rosewarne | 83/329 X |
| 1,729,436 | 9/1929 | Bronander | 83/490 X |
| 2,093,322 | 9/1937 | Lamoreaux | 83/490 X |
| 2,838,947 | 6/1958 | Sarka | 83/298 X |
| 3,213,731 | 10/1965 | Renard | 83/490 X |
| 3,332,301 | 7/1967 | Popp et al. | 83/313 X |
| 3,380,331 | 4/1968 | Boothe, Jr. et al. | 83/490 X |
| 4,041,813 | 8/1977 | Spencer | 83/329 X |
| 4,928,713 | 5/1990 | Arthur | 83/298 X |

*Primary Examiner*—Richard K. Seidel
*Assistant Examiner*—Raymond D. Woods
*Attorney, Agent, or Firm*—Francis J. Bouda

[57] ABSTRACT

The machine cuts a roll or log (L) of web material into a plurality of small rolls (R). It includes a unit (17) rotating about an axis (A—A) parallel to the axis of the log (L) to be cut. The unit carries a cutting blade (19) rotating about an axis (B—B) parallel to the axis (A—A) of the unit (17). A driving device (61, 63) moves the cutting tool (19) into a reciprocating forward and backward motion parallel to the axis of the log (L) to be cut. At least at the time when the blade cuts the log, the blade moves parallel to the moving log at a translation speed substantially equal to the feeding speed of the log (L), so as to allow the cutting of small rolls (R) without stopping the log (L).

17 Claims, 9 Drawing Sheets

Fig. 4A
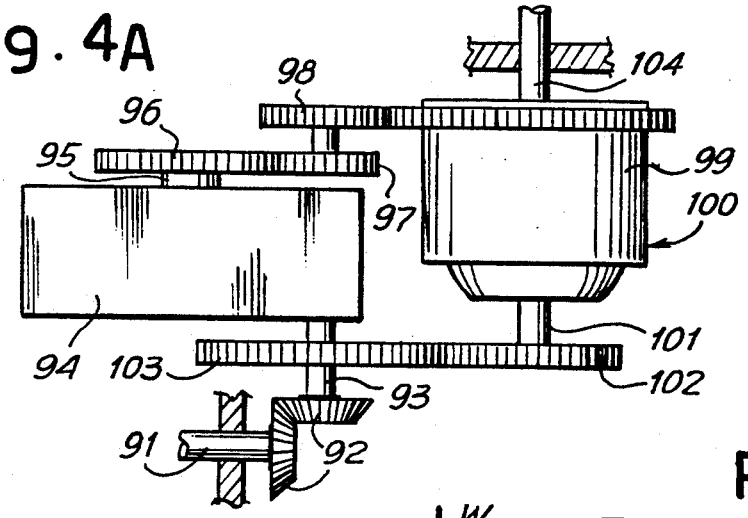
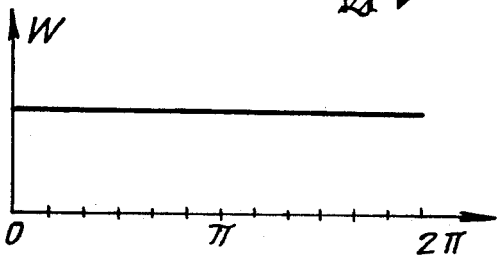
Fig. 4B
Fig. 4C
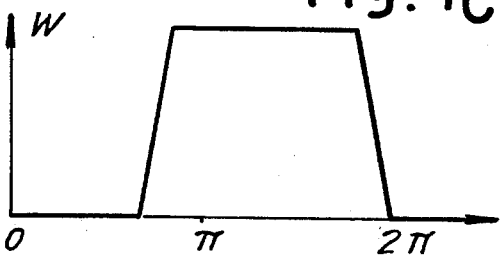
Fig. 4D
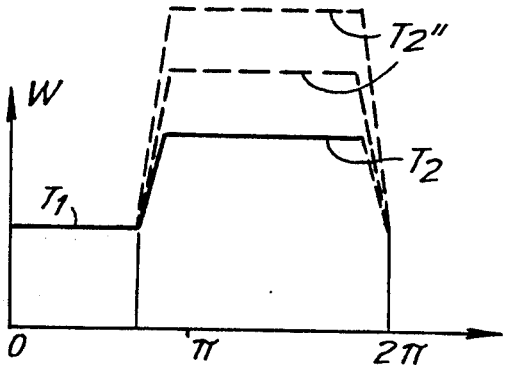
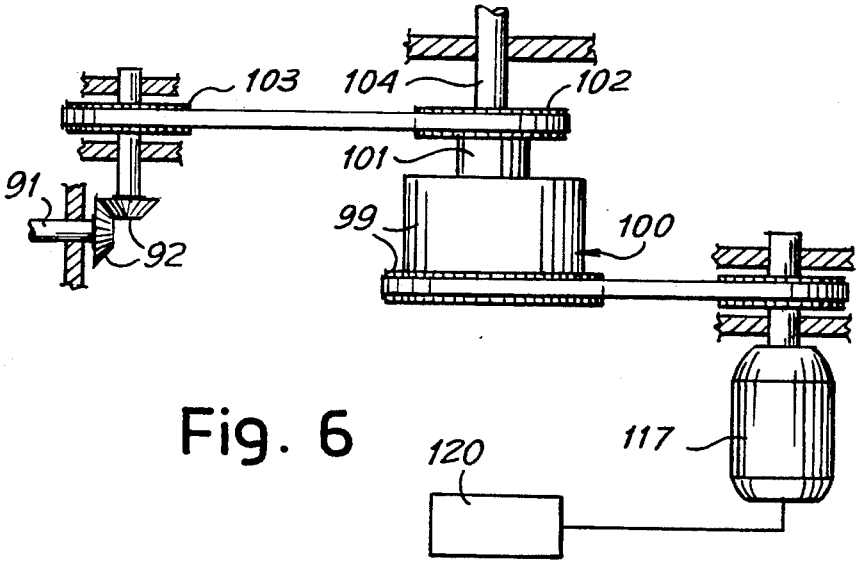
Fig. 6

291
292
305
306
291C
294
293
296
295
298
300
297
299
304

VII
VII
5
5
5
5
L
L
R
R
135A
135A
130
130
130A
130B
132A
132A
132B
132B
134A
134A
134B
134B
137
137
137
137
139
139
139
139
143
143
143
143
145
145
155
155
155
155
161
19
19
fL
fL

MACHINE FOR CUTTING LOGS OF WEB MATERIAL

BACKGROUND OF THE INVENTION

The invention relates to a machine for cutting rolls or logs, formed by wound web material, to form a plurality of shorter rolls. The invention relates also to a method for cutting logs and forming small rolls therefrom.

More particularly, the invention relates to a cutting machine comprising a unit rotating about an axis parallel to the axis of the log to be cut and carrying a cutting tool rotating about an axis parallel to the axis of rotation of said unit.

Presently known cutting machines of this type are able to carry out cutting operations with the log at a standstill. Once the log to be cut has been placed on the machine guide and fastened thereon, the rotating blade of the machine cuts a small roll while the log remains stationary. When the blade is clear of the log, the latter is moved forward an increment equal to the length of the roll to be cut, and then stopped again to perform the next cut. These machines work, therefore, in an intermittent manner. This creates lost work times and drawbacks due to the intermittent motion imparted to the log and, in particular problems of inertia due to difficulties in controlling the log motion, frequently leading to non-uniform lengths of the small rolls.

In view of the above, cutting machines have been studied in which the cutting of the log takes place by keeping the log in motion also during the cutting operation. Such a machine is described in U.S. Pat. No. 4,041,813. In these machines, the rotary cutting blade is carried by a unit which, in turn, rotates about an axis inclined to the axis of the log to be cut. In this way, as the blade-carrying unit rotates, the blade moves with a motion which has, on a horizontal plane, which passes through the axis of the log to be cut, a component which is parallel to the log axis. Since whatever the angular position of the blade-carrying unit, the blade of the cutting tool has to lie always in a plane perpendicular to the axis of the log to be cut, and thus these machines require a complex kinematic system which keeps the axis of the cutting blade constantly parallel to the log axis. An oscillatory motion of the tool axis with respect to the tool-carrying unit is thus obtained.

These second types of machines have a particularly complex construction. Moreover, the law of motion of the cutting tool is not the optimal one, because the tool motion, as projected onto the horizontal lying plane of the axis of the log to be cut, is a sinusoidal motion.

It is, therefore, an object of the invention to provide a cutting machine as above defined which allows, by a particularly simple and reliable structure, the cutting of logs which are continuously moving.

These and other objects, which will appear evident to those skilled in the art by the following description, are achieved by a machine characterized by means which give said cutting tool a reciprocating forward and backwards motion parallel to the axis of the log to be cut, said tool having a translation speed during the cutting step which is substantially equal to the feeding speed of the log to be cut.

Among the several advantages obtained in this way, the first to be mentioned is the increase of productivity and, secondly, a greater uniformity of the finished product. In fact, since the log to be cut is never brought to a definite stop, the phenomena of inertia, which in the known machines cause the cutting of small rolls of different lengths, are much reduced or even eliminated.

In one embodiment of the machine according to the invention, the means for imparting the reciprocating motion to the cutting tool are combined to the bearing shaft of the rotating unit on which said cutting tool is supported. A particularly compact structure is thus obtained. In practice, a cam may be secured to said shaft to cooperate with a fixed tappet.

To achieve the above-mentioned advantages of higher productivity and elimination of inertia phenomena, it is not necessary that the feeding speed of the log to be cut be constant. On the contrary, provision may be made for the speed to vary between a minimum value during the cutting, that is, when the tool is within the log to be cut, and a maximum value, when the tool is cleared of the log. This brings about the advantage of limiting the forward travel of the tool and thus the resulting accelerations, with a substantial reduction of mass and size of the cutting means, without the logs being stopped and, therefore, with consequent less inconveniences due to the inertia of the logs.

This makes it possible also to build a machine in which the length of the small rolls can be easily changed, as it will be apparent from the following description of an exemplary embodiment. In this case-, there must be provided means for feeding the log to be cut and means which connect said log-feeding means to the means which impart the rotational motion to said rotating unit. The connection means ensure the synchronism between the motion of the rotating unit and the motion of the feeding logs. The connection can be of the mechanical type, or an electronic connection may be provided through programming means such as a microprocessor, or other means capable of maintaining the synchronism between the motion of the logs feeding means and the driving means of the rotary unit. In this way, provision may be made for the connection means to impart a motion at variable speed to the log-feeding means while said rotary unit moves at constant speed.

The invention further relates to a method for transversely cutting logs to form small-size rolls, wherein the log is fed to a cutting group comprising a tool for transversely cutting the logs, said tool rotating about its own axis and about an axis which is parallel to the tool axis and parallel to the axis of the log to be cut, characterized in that the log is moved forward by a continuous motion, the cut taking place with the log in motion while the tool moves at a speed equal to that of the log.

In a particularly advantageous embodiment, the log is moved forward at a varying speed, that is at a reduced speed during the cutting operation and at a higher speed between subsequent cuttings. The higher speed may be adjusted to change the length of the small rolls obtained from the cutting of the logs.

Further advantageous embodiments of the present invention are set forth in the appended claims.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

FIGS. 4A, 4B, 4C, 4D show diagrammatically a kinematic chain for transmitting the motion to the log-feeding means, and three speed curves, respectively.

FIG. 6 shows a kinematic scheme of a modified embodiment for transmitting the motion to the log-feeding means.

Figure 1:
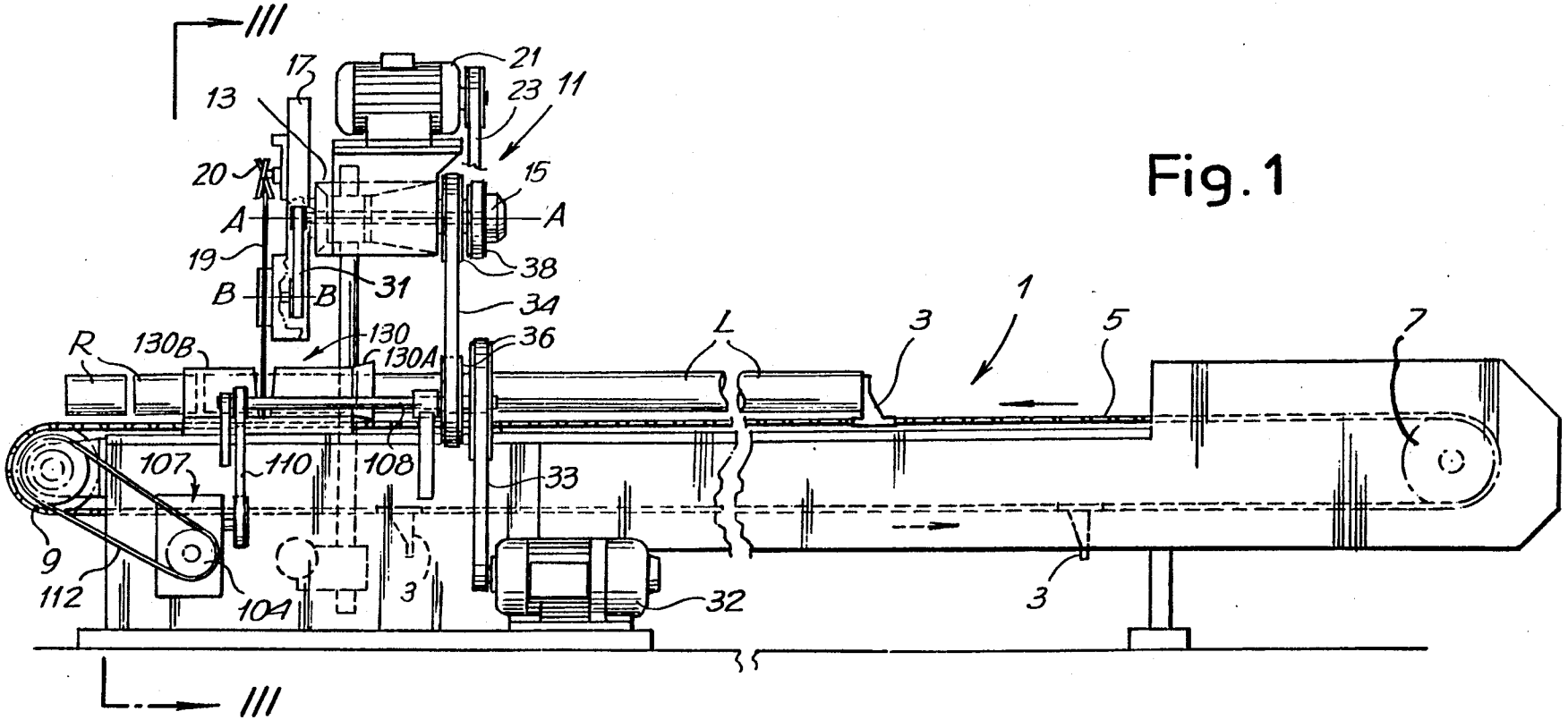
FIG. 1 shows a schematic side view of a cutting machine according to the invention.

In FIG. 1, numeral I designated the cutting machine as a whole. L indicates a log or roll to be cut. Each log is made to advance by means of a series of pushers, three of which are designated 3 in FIG. 1. The pushers 3 are borne by endless chain or belt 5 driven between wheels 7 and 9. Said pushers push the logs L with a continuous motion at a non-constant speed, as will be described later in greater details, towards a cutting group designated 11 as a whole, wherein each log is cut to form a plurality of small rolls R. In practice, the machine is capable of simultaneously cutting several logs, for example two or three logs, located parallel to each other, as can be seen in FIG. 3.

Figure 2:
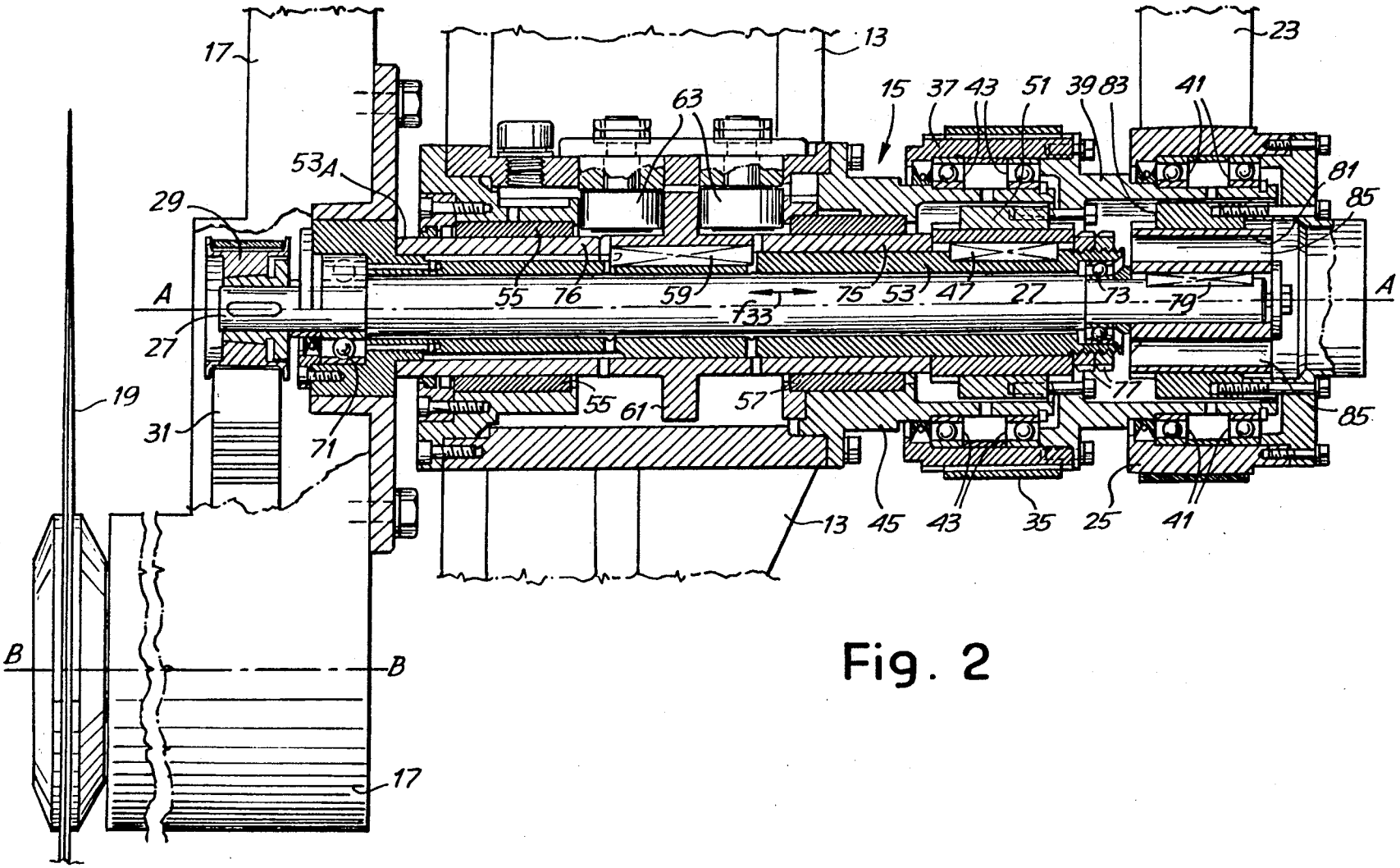
FIG. 2 shows a longitudinal section of the system for the reciprocating motion of the cutting tool.
Figure 3:
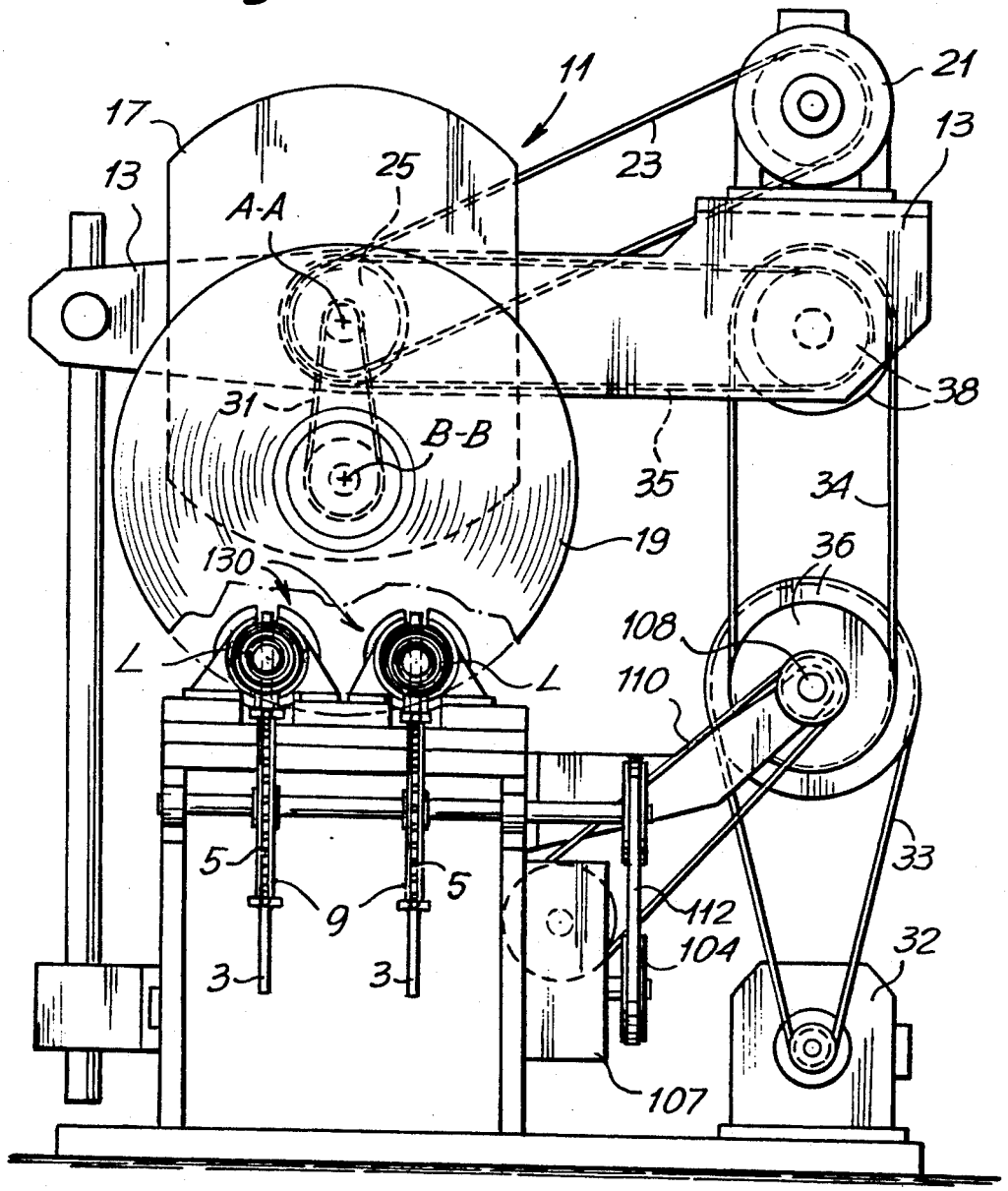
FIG. 3 shows a view on line III—III of FIG. 1.

As can be seen in particular in FIGS. 2 and 3, the cutting group comprises an arm 13 supporting a spindle, generally indicated by 15, mounted thereon and carrying a plate 17 which rotates about the axis A—A of the spindle 15 (FIG. 2). Mounted on plate 17 is a cutting tool, hereinafter referred to as blade 19, rotating about its axis B—B parallel to axis A—A. The blade 19 is driven into rotation by a motor 21 which, via a belt 23 moved around pulley 25, transmits the rotational motion to a shaft 27 located inside the spindle 15 (FIG. 2). Opposite pulley 25 on shaft 27, there is keyed a pulley 29 on which a belt 31 is driven for transmitting the motion to blade 19 via a pulley not shown. Also mounted on plate 17 are grinding wheels 20 for sharpening of blade 19 (FIG. 1).

The plate 17 is driven into rotation about its axis A—A by a motor 32 which transmits its motion to the spindle 15 via three belts 33, 34, 35 (FIGS. 1 and 3) and a series of pulleys 36, 37, 38, the pulley 37 being coaxial to pulley 25 and secured to spindle 15. More particularly, the pulley 37 is fixed to a sleeve 39 on which the pulley 25 is supported through the bearings 41. The pulley 37 is supported by bearings 43 on a bush 45 secured to arm 13. The sleeve 39, and thus the pulley 37, are engaged, through a key 47 and two splined members 49, 51, to a hollow shaft 53 and rotate therewith. Said shaft is engaged to the plate 17 and supported on arm 13 by bearings 55, 57 which allow (in addition to the rotation of shaft 53 about the axis A—A) also a limited translation motion in the direction f33, that is, parallel to axis A—A, while the pulley 37 does not move in the axial direction. The bearings 55, 57 may be either sliding bearings or special rolling bearings of a type well-known.

Keyed on the hollow shaft 53 through a key 59 is a cam 61 which cooperates with two tappets 63 made up of two rollers which are idly mounted on the arm 13 and have axes of rotation parallel to one another and perpendicular to the axis A—A. The cam 61 and the tappets 63 are provided for driving the hollow shaft 53, and thus plate 17 and rotating blade 19 as well into a reciprocating motion of translation in the direction f33, for the purposes to be indicated below.

The hollow shaft 53 makes up seats for housing the bearings 71, 73 to support the inner shaft 27 which is axially engaged to the hollow shaft 53 so as to move therewith. The translation of the hollow shaft 53 with respect to pulley 37 and sleeve 39 is made possible by the spline-profile coupling formed by the two splined members 49, 51. The member 49 is secured on the hollow shaft 53 by a spacer 75 and a pair of ring nuts 77 which tighten also the cam 61 and the other spacer 76 against a shoulder 53A. The axial sliding of the inner shaft 27 with respect to pulley 25 is obtained in a similar way. In fact, the shaft 27 is connected to the pulley 25 through a key 79 which connects said shaft to a first intermediate splined member 81 which fits into a second intermediate splined member 83 fastened to pulley 25. The intermediate member 81 has a plurality of cylindrical holes 85 with axes parallel to the axis A—A, which provide for lightening the same member 81 and to circulate the oil contained in the housing of shafts 27, 53 and of cam 61.

The above-described disposition allows the blade 19, which rotates about its own axis B—B, to perform a rotational movement at uniform speed about the axis A—A and a reciprocating translation movement in a direction parallel to axes A—A and B—B driven by the cam 61. It thus follows that at each revolution of plate 17 about its own axis, the blade 19 performs a complete forward and backward travel. As the plate 17 rotates about the axis A—A, the logs L are made to advance by the pushers 3 with a motion suitably synchronized with the rotary motion of blade 19 about the axis A—A.

During this rotary motion, the blade 19 describes a lower arc, of about 120°, along which the said blade acts on one or more logs which are temporarily at the cutting position, and an upper arc, of about 240°, along which the blade is clear of the logs. In practice, the construction of the machine is such as to allow more logs, mostly two or three, disposed parallel to each other, to be cut simultaneously. The arc along which the blade 19 is engaged within the logs to be cut depends on the number of logs which are cut at each revolution of the plate 17 about the axis A—A.

Since the plate 17 and the blade 19 are provided with an intermittent forward and backward motion in the direction of axis A—A, it is possible, by a suitable shape of cam 61 and a proper synchronism between the motion of plate 17 and pushers 3, to perform the cutting of the logs without stopping them, because the blade 19, while it is engaged within the logs, is provided with a feeding motion in a direction parallel to the feeding direction of the logs and at a speed equal to the feeding speed of said logs.

Theoretically, having a cam 61 of suitable shape, it is possible to cut the logs by keeping the latter at a constant feeding speed and moving the blade forward along the axis A—A of a sufficient extent during the time interval in which the blade is engaged with the logs. This involves, however, the need of making a spindle 15 of large dimensions. To reduce the spindle dimensions and the accelerations of the rotating unit without giving up the advantages of a continuous advancement of the logs, provision may be made that the motion of logs L will take place at variable speed, with a higher speed when the blade 19 is clear of the logs, and a reduced speed when the blade 19 carries out the cut, i.e., when it is engaged with the logs.

To this end, means must be provided for transmitting the motion to the chain 5, which means allow the speed of advancement of the logs to be modified in such a way as to be in synchronism with the motion of the plate 17 and thus of the blade 19.

In a first embodiment of the invention, this is obtained by using an intermitter and an epicyclic train. FIGS. 4A, 4B, 4C and 4D show a basic scheme of the apparatus and three speed diagrams. With reference to the scheme of FIG. 4A, the rotary motion of motor 32 is transmitted to the shaft 91 which, by a pair of bevel gears 92, transmits the motion to the input shaft 93 of an intermitter 94. The intermitter 94 has an output shaft 95 which moves with intermittent motion when the input motion is continuous and at constant speed. The motion of shaft 95 is transmitted, via a train of gears 96, 97, 98, to the gear-holding case or box 99 of an epicyclic train generally designated 100. Numeral 101 indicates one of the axles of the train 100, which is kinematically connected, via two gears 102 and 103, to the input shaft 93 of the intermitter 94.

Numeral 104 indicates the other axle of the train 100. The axle 104 is connected to one of the wheels 7, 9 on which the chain 5 is driven. Since the hollow shaft 53 and the plate 17 must rotate at constant speed, the motor 32 drives the intermitter input shaft 93 into a continuous motion at constant speed, as diagrammatically shown in FIG. 4B, where the angle of rotation of the plate 17 about the axis A—A is plotted in abscissa and the rotational speed in ordinate. The intermitter 94 is built in such a way as to have on the output shaft 95 a speed represented by the curve in the diagram of FIG. 4C, where the abscissa corresponds to the angle of rotation of plate 17 and the ordinate the rotary speed value of shaft 95 corresponding to a constant rotary speed of input shaft 93. As can be seen from this diagram, the speed of the output axis of intermitter 94 is zero for the whole time the plate 17 takes to run an arc corresponding to the engagement angle of the blade within the log(s) to be cut (about 120°), and then changes rapidly up to a value, possibly constant and, anyhow, different from zero, which is maintained for a rotation arc of the plate 17 equal to the angle along which the blade 19 is not engaged within the logs L. Then, the speed of shaft 95 rapidly drops again down to zero value when the blade 19 becomes again engaged with the logs.

The diagram of FIG. 4D shows the curve of the speed of rotation of axle 104, which is proportional to the speed of translation of chain 5 and thus to the feeding speed of logs L. This diagram is given by the sum of the diagrams shown in FIGS. 4B and 4C. As clearly shown by this diagram, during each revolution of plate 17 about axis A—A, the rotational speed of axle 104 and thus the feeding speed of logs L have a first interval T1 along which the log feeding speed is constant and of lower value than along the next interval T2, this second interval T2 showing a log feeding speed which is higher than during the interval T1 and possibly constant-(as in the illustrated example). The two intervals are joined by acceleration and deceleration intervals. Mechanically, this is achieved by means of the epicyclic train 100 for which the following relation can be expressed:

$$W = Aw1 + Bw2$$

wherein W is the speed of rotation of the gear-holding case or box, w1 is the speed of the input axle 101, w2 is the speed of the output axle 104, and A and B are real numbers which depend on the internal ratios of the epicyclic train used.

The speed of the axle 104 along the interval T1 is determined not only by the rotary speed of shaft 93 (and thus by the rotary speed of plate 17), but also by the transmission ratio between the shaft 93 and the axle 101, which ratio is defined by gears 102 and 103. This speed is such as to provide the logs L with the same feeding speed as that of blade 19 along the same interval. Accordingly, once defined, such speed must remain constant, unless the cam 61 is changed.

Vice versa, the speed of input axis 93 of the intermitter being equal, the speed of axle 104 along the interval T2 may be changed without affecting the cutting operation, as the blade is not engaged in the logs during the interval T2. By varying this speed, therefore, it is possible to change the distance between two subsequent cuts made on the logs, and thus the length of each small roll produced by the machine. The speed variation along the interval T2 is achieved by suitably replacing the gears 96, 97, 98 and the gear solid to the box 99 of the epicyclic train 100.

Figure 5A:
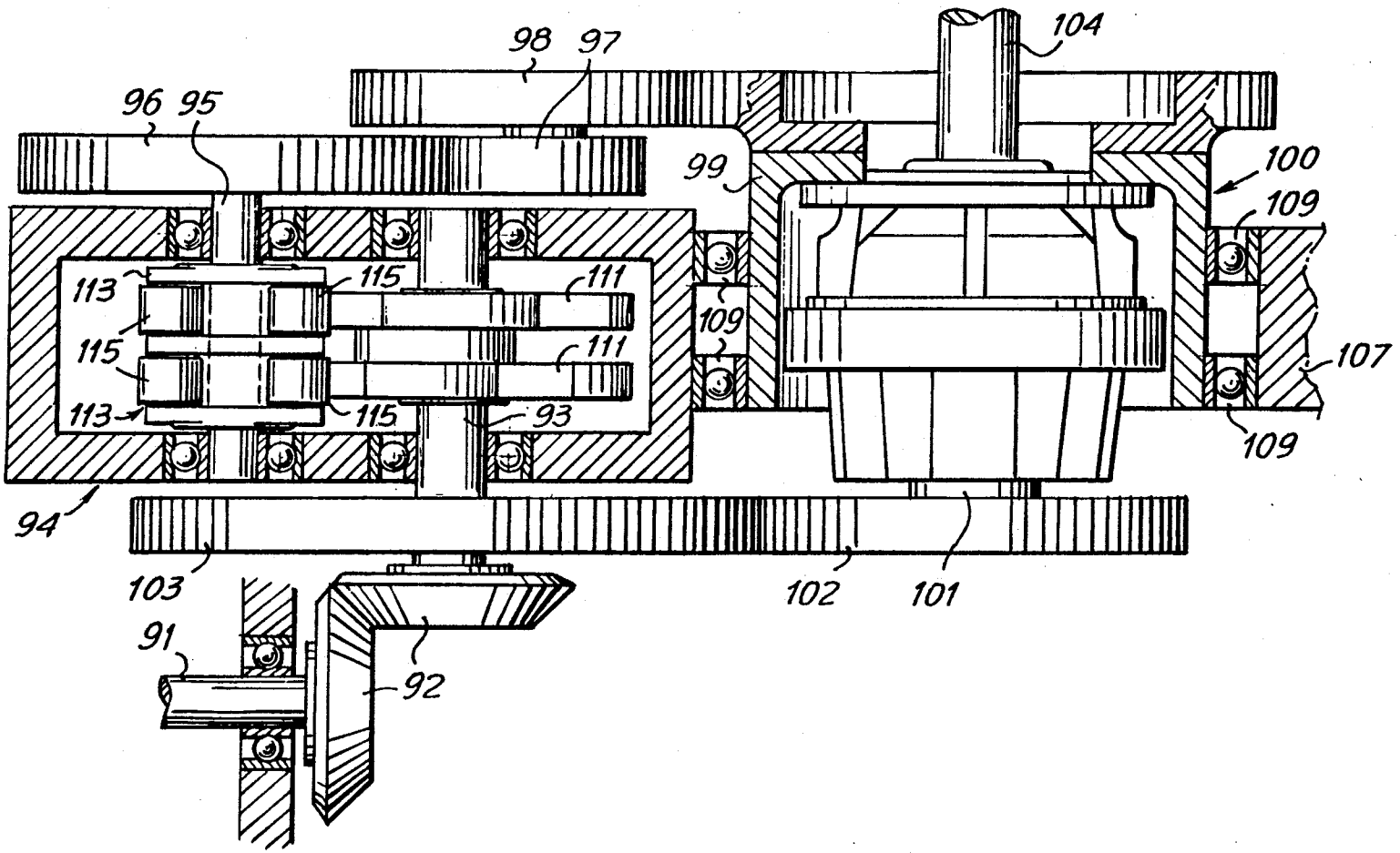
FIG. 5A shows a section view of an apparatus embodying the kinematic scheme of FIG. 4A.

FIG. 5A shows an embodiment of the kinematic scheme of FIG. 4A. In this figure, parts corresponding to the elements of FIG. 4A are indicated by the same reference numbers. All the apparatus is oil-bathed within a box whose portion 107 is shown on the right side of FIG. 5A. To achieve a more compact construction, the gear-holding case or box 99 of the epicyclic train 100 is supported by bearings 109 housed within the box 107. The intermitter 94 may be of known type and will be summarily described herein. In the exemplary embodiment shown in FIG. 5A, the intermitter is provided with a pair of cams 111, keyed on shaft 93, which cooperate with two disks 113 keyed on shaft 95, and each carrying a plurality of wheels 115 acting as tappets for the relevant cams 111. The shape of cams 111 and the dimension and disposition of wheels 115 are such as to drive the output shaft 95 with the desired equation of motion.

The position of box 107 is shown in FIGS. 1 and 3. The motion of motor 32 is transmitted to box 107 through belt 33, pulleys 36, shaft 108 and toothed belt 110. The output axle 104 is kinematically connected to the axis of wheels 9 which drive the chains 5 (FIG. 3).

Figure 5B:
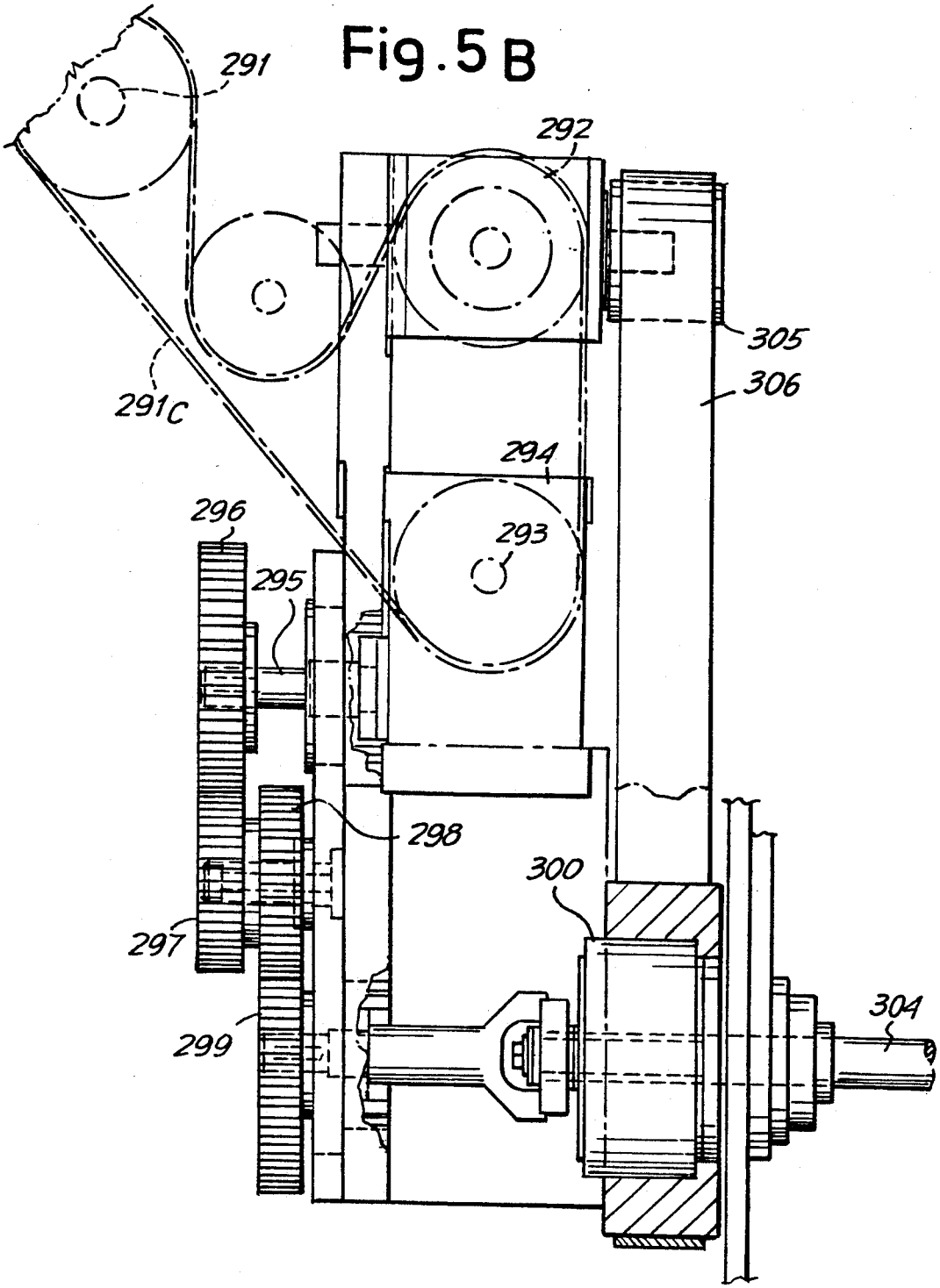
FIG. 5B shows a modified version of an embodiment of a kinematic chain corresponding to the mechanism of FIG. 5A.

FIG. 5B shows a slightly modified embodiment of the kinematic scheme of FIG. 4A. In this figure, numeral 291 indicates the shaft which derives the motion from motor 32. The motion of shaft 291 is transmitted, through a relevant belt 29, to a pair of bevel gears 292 and to the input shaft 293 of an intermitter 294. The output shaft 295 of the intermitter 294 is connected, via a gear train 296, 297, 298, 299, to an axle of a gearing 200 having the same functions as the gearing 100 of FIG. 5A. The gear-holding box 399 draws the motion, through a belt 306 and a pulley 305, from the pair of bevel gears 292. The output axle 304 of gearing 300 operates the advancement of the logs L through the pushers 3.

FIG. 6 shows a different solution for the transmission of motion to chain 5. In this case, the motion from shaft 91, which rotates at a speed proportional to the speed of rotation of plate 17 about the axis A—A, is transmitted via the pair of bevel gears 92 to the toothed pulley 103 and, from this, to the other toothed pulley 102 which is keyed on an axle 101 of the epicyclic train 100. The gear-holding case or box 99 of the epicyclic train 100 is kinematically connected to a motor 117 which is, in turn, connected to a central processing unit, schematically indicated at 120. In this case, the desired equation of motion for the output axle 104 of epicyclic train 100 is obtained by suitably programming the central unit 120. The motor 117 remains stopped during each time interval during which the blade 19 is engaged within the logs to be cut, whereas it is driven into rotation during the time interval in which the blade 19 is not active. When the motor 117 rotates, the speed of axle 104 is increased in a way similar to the one obtained with the intermitter 94 of FIGS. 4A and 5. The different lengths of small rolls being cut are achieved in this case by acting on the number of revolutions or fractions of revolutions of the motor 117 during each operative period.

Figure 9:
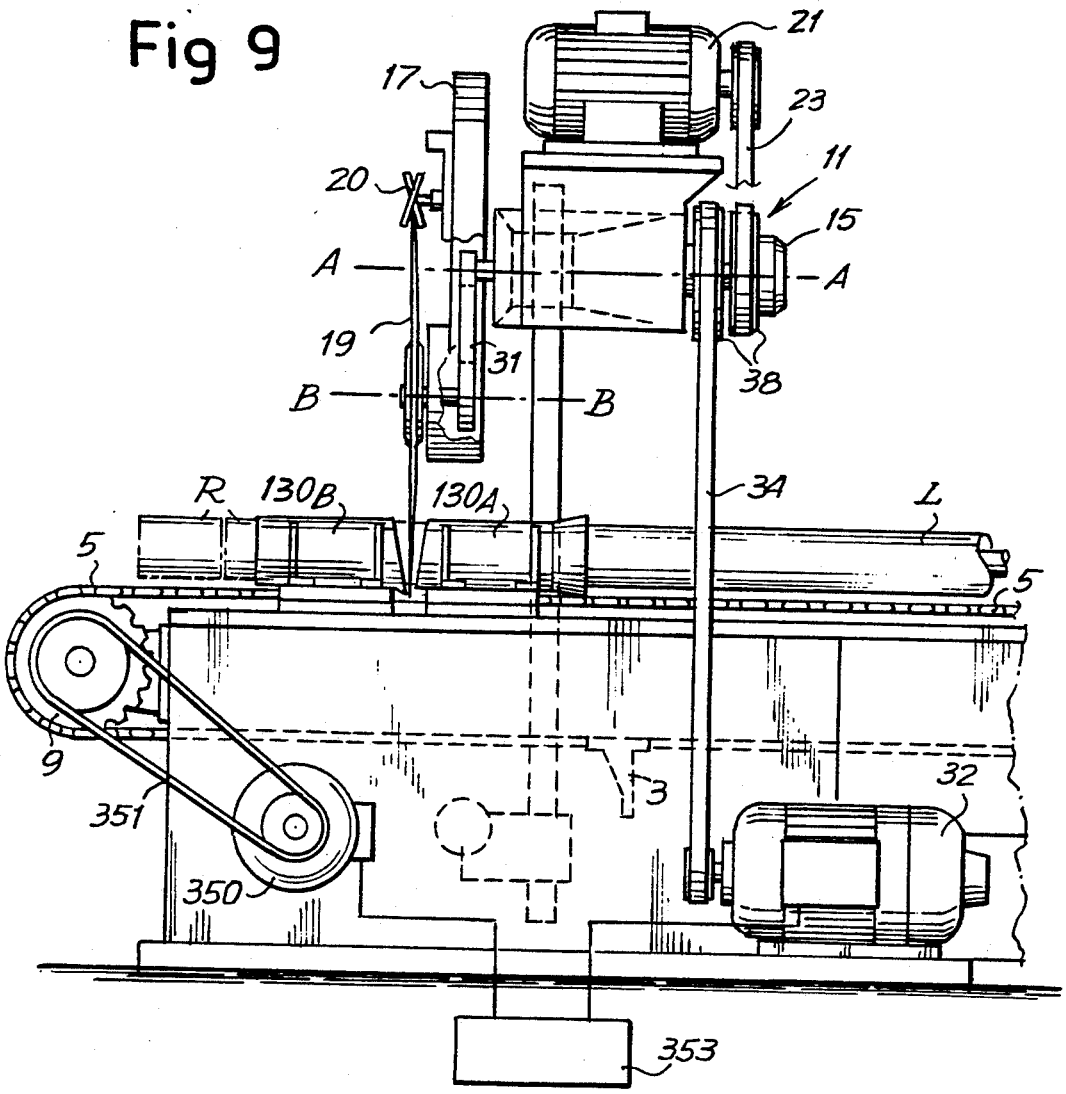
FIG. 9 shows an electronic synchronizing system.

FIGS. 4 to 6 show mechanical systems for the synchronism between the rotary motion of the unit 17 about axis A—A and the feeding motion of the log L to be cut. This synchronism, however, may also be obtained by an electronic system shown in FIG. 9 which shows the cutting group 11 and the actuation motors. In this embodiment (where like parts or parts corresponding to the embodiment of FIG. 1 are indicated by the same reference number), the motor 32 drives into rotation only the unit 17 about axis A—A through the belt 34. The advancement of logs L is accomplished by an independent motor 350 which is connected via a belt 351 to pulleys 9 which drive the chains 5. The motor 350, which may be mounted in axial alignment with pulleys 9, is connected to a central processing unit 353. Also connected to the central processing unit 353 is the motor 32. The central processing unit 353 is programmed in such a way as to cause an advancement of the logs L at variable speed and in synchronism with the rotation of unit 17.

Figure 7:
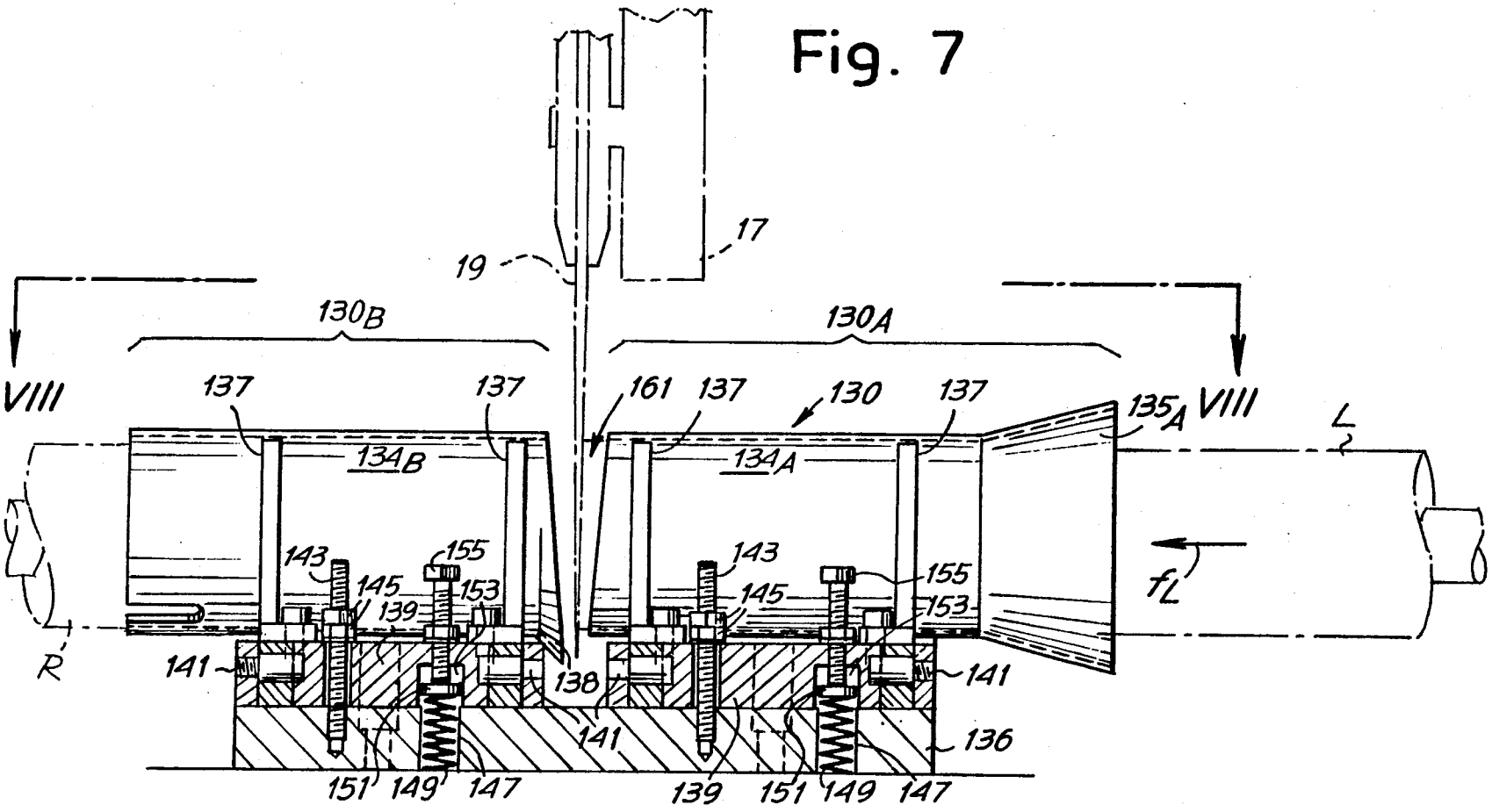
FIG. 7 shows a view on line VII—VII of FIG. 8 of the means for retaining the logs during cutting.
Figure 8:
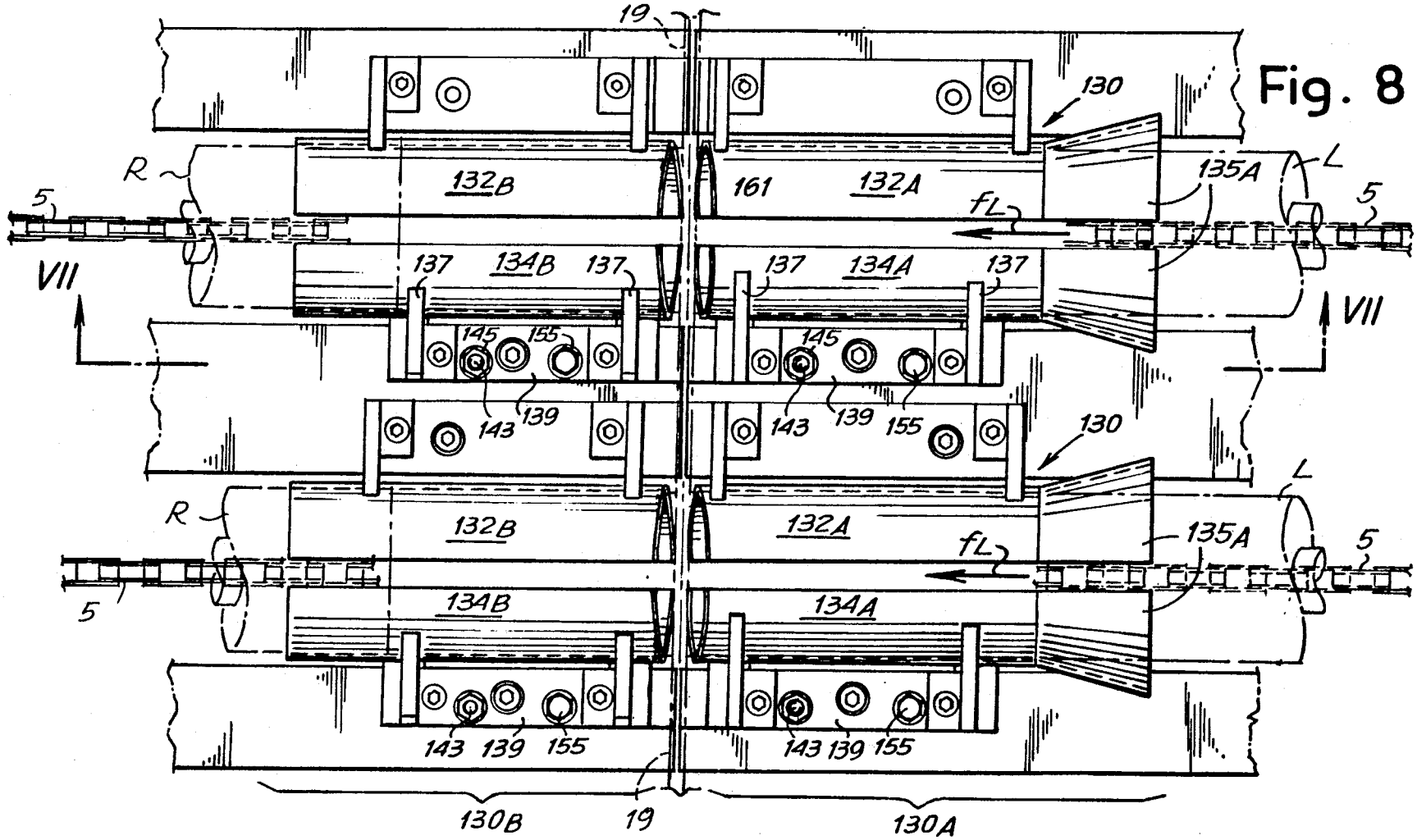
FIG. 8 shows a plan view on line VIII—VIII of FIG. 7.

In the cutting region, the logs L are sideway retained by clamping means generally indicated by 130 in FIGS. 1, 7 and 8. As can be seen in FIG. 8, the machine illustrated by the exemplary embodiment has two parallel clamping means 130 for the simultaneous cut of two logs L which move forward in the direction of arrow fL. Each clamping means is formed by two portions 30A and 130B, respectively, and each portion is, in turn, made up of two symmetrical semi-cylindrical shells shown at 132A, 134A and 132B, 134B, respectively (FIG. 8). The shells 132A, 132B are fixed and rigidly connected to a base 136, while the shells 134A and 134B are resiliently engaged to the base 136. The resilient connection is obtained as follows. Each shell 134A, 134B is borne by brackets 137 fixed to respective elements 139 supported on the base 136 by pivot pins 141. Combined with each element 139 is a thread bar 143 which is screwed down in a dead hole on base 136 and passes through a hole of the respective element 139. Nuts 145 screwed on the thread bar 143 form an upper abutment for the relevant element 139. Also provided in the base 136 are holes 147 Which house compression springs 149 (one for each element 139) which react against a plate 151 sliding into a relevant hole 158 formed in each element 139. The position of plate 151 can be adjusted by respective screws 155. The screws 155 define the degree of compression of the springs 147. With this disposition, the springs 147 tend to keep the shells, which form each clamping means, as close as possible to each other by leaving the minimum space for the log passing therebetween and thus providing a logs retaining force. The restricted oscillation possibility of shells 134A, 134B allows the clamping means to fit possible slight differences in the diameter of subsequent logs. The force of springs 147 is such as to exert on logs L a friction force sufficient to prevent the log from advancing by inertia and thus losing contact with pushers 3 when the latter slow down.

Each shell 132A, 134A has a flared inlet portion, indicated by 135A, which forms a guide for the incoming logs. Similarly, each shell 132B, 134B has a flared portion 138 (FIG. 7) for the same purpose. Between the two portions 130A, 130B of the clamping means 130 is an interspace 161 having wedge-shape development with a maximum spacing in the upper side of the clamping means and a minimum spacing at the bottom thereof. It is within this space that the blade 19 passes during cutting. The blade 19 moves forward with a feeding motion and a rotary motion about the axis A—A, and when it enters the interspace 161 it is located at a high position with respect to the axis of the logs, and in its back position with respect to the feeding direction. As the cutting goes on, the blade 19 is lowered towards the base 136 and moves forward in the log feeding direction fL and it has run half of its feeding travel when it reaches the position of maximum lowering. Then it starts to rise again while continuing to move forward. This is why the interspace 161 can be made of wedge-like uniform and symmetrical shape by reducing the distance between portions 130A, 130B thereby improving the guide of logs L.

It is understood that the drawing shows an exemplification given only as a practical demonstration of the invention, as this may vary in the forms and dispositions without, nevertheless, departing from the scope of the idea on which the present invention is based. The presence of reference numbers in the appended claims has the purpose of facilitating the reading of the claims, reference being made to the description and the drawing, and does not limit the scope of the protection represented by the claims.

Having thus described my invention, what is claimed as new and desired to protect by Letters Patent are the following:

1. A machine for cutting a log (L) of web material into a plurality of small rolls (R), comprising:

a unit (17) rotating about an axis (A—A) parallel to the axis of the log (L);

on said unit a cutting blade (19), rotating at a substantially constant speed about an axis (B—B) parallel to the axis (A—A) of said unit (17) said blade being rotated by a blade drive means and a first shaft, with said first shaft having a splined connection to the drive means so that said cutting blade and said first shaft move axially independently of said drive means;

means (61, 63) which drive said cutting blade (19) into a reciprocating forward and backward axial motion parallel to the axis of the log (L);

log feeding means (3, 5, 7, 9) for feeding the log (L) to be cut in a forward direction parallel to the axis of rotation of said blade; wherein said log feeding means moves said log at a lower speed during cutting and at a higher speed between each two sequential cuttings performed on said log, said lower speed being equal to the speed of the axial motion of said cutting blade in the forward direction parallel to the axis of the rotation of said blade, during a cutting operation of said blade; and wherein synchronizing means (94–100, 99–120, 353) are provided for keeping a synchronism between the reciprocating axial motion of the cutting blade and the log feeding means.

2. A machine according to claim 1, wherein said means (61, 63) which drive the cutting blade (19) into a reciprocating motion comprise cam and tappet members.

3. A machine according to claim 2, characterized in that said means (61, 63) which drive the cutting blade (19) into a reciprocating motion, are combined to a second shaft (53) which supports the rotating unit (17) on which said cutting blade (19) is supported.

4. A machine according to claim 3 characterized in that supported inside said second shaft (53) supporting the rotating unit (17) is said first shaft (27) for rotating the cutting blade (19), said first shaft (27) being supported in such a way as to be able to slide together with said second shaft (53) supporting the rotating unit.

5. A machine according to claim 1 including mechanical connection means (91–104; 99–104, 117, 120) which mechanically connect said log feeding means (3, 5, 7, 9) to means (32) which impart the rotary motion to said rotating unit (17), said mechanical connection means ensuring the synchronism between the axial motion of the rotating unit (17) and the log (L) feeding motion.

6. A machine according to claim 5, characterized in that said mechanical connection means comprises an epicyclic train (100), an axle (101) of which rotates at a speed proportional to the rotary speed of the rotating unit (17), and means (94, 95, 96, 98; 117, 120) to move a gear-holding box (99) of said epicyclic train (100) with an intermittent speed, an output axle (104) of the train (100) being connected to said log feeding means (3, 5, 7, 9).

7. A machine according to claim 6, characterized in that combined to the epicyclic train (100) is an intermitter (94) including an input shaft (93) which rotates at a speed proportional to the rotary speed of the rotating unit (17), and including an output shaft (95) kinematically connected to the gear-holding box (99) of said epicyclic train (100).

8. A machine according to claim 7, including means whereby the velocity ratio between the output shaft (95) of the intermitter (94) and the gear-holding box (99) of the epicyclic train (100) is modified.

9. A machine according to claim 8, characterized in that a set of gears (96, 97, 98) is interposed between said output shaft (95) of the intermitter (94) and the gear-holding box (99), at least some of which gears are replaced in order to modify the velocity ratio.

10. A machine according to claim 6, characterized in that a motor (117) controlled through a central processing unit (120) is combined to the gear-holding box (99) of the epicyclic train (100).

11. A machine according to claim 1, including a means (113) for retaining logs (L) during cutting, which include, for each log (L) to be cut, a clamping means (130) formed into two portions (130A, 130B) within which the log (L) slides, said portions being coaxial to each other and spaced apart by an extent sufficient to allow axial displacement of the cutting blade (19).

12. A machine according to claim 11, characterized in that between the two portions (130A, 130B) of each clamping means (130) there is provided an interspace (161) having a dimension which varies, said interspace having a minimum dimension at a bottom and a maximum dimension at a top of the clamping means (130).

13. A machine according to claim 11, characterized in that each portion of each clamping means (130) is formed by two substantially symmetrical members (132A, 134A; 132B, 134B), at least one of which is resiliently urged towards the other.

14. The machine of claim 1 including on said unit (17) a pair of grinding wheels which move axially with said cutting blade.

15. A method for transversal cutting of a log into a plurality of small rolls, comprising the steps of:

providing a cutting unit;

advancing said log toward said cutting unit with a continuous motion;

providing a rotating cutting blade on said cutting unit;

rotating said unit about an axis parallel to the axis of the log;

rotating said rotating cutting blade at substantially constant speed in an orbit which has an axis which is parallel to the axis of the log, said blade performing subsequent cuts on said log, perpendicularly to the axis of the log; providing a blade drive means and a shaft for rotating said cutting blade, with a splined connection between said drive means and said shaft;

reciprocatingly moving said cutting blade in a direction parallel to the axis of the log whereby said cutting blade and said shaft move axially independently of said drive means;

moving said log at a first lower feeding speed during cutting, said lower feeding speed substantially corresponding to the axial speed of said cutting blade during forward motion thereof and at a second higher feeding speed between each two sequential cuttings performed on said log, while the cutting blade is moved backwards;

synchronizing the advancing movement of said log with the axial reciprocating movement of the cutting blade.

16. A method according to claim 15, characterized in that the higher feeding speed is changed in order to vary the length of the small rolls (R) obtained from the cutting.

17. The method of claim 15 including providing on said unit (17) a pair of grinding wheels which move axially with said cutting blade.

* * * * *